US005469238A

United States Patent [19]

Biegler

[11] Patent Number: 5,469,238

[45] Date of Patent: Nov. 21, 1995

[54] FILTER FOR A PHOTOTHERMOGRAPHIC DEVELOPER

[75] Inventor: Robert M. Biegler, Woodbury, Minn.

[73] Assignee: Minnesota Mining and Manufacturing Company, St. Paul, Minn.

[21] Appl. No.: 322,977

[22] Filed: Oct. 13, 1994

[51] Int. Cl.[6] ..... G03D 7/00

[52] U.S. Cl. ..... 354/300; 95/256; 95/263; 95/290

[58] Field of Search ..... 354/300; 55/70, 55/71, 316, 387; 128/205.27, 206.12; 34/630; 210/496; 219/121 LC

[56] References Cited

U.S. PATENT DOCUMENTS

| | | | |
|---|---|---|---|
| 3,457,075 | 7/1969 | Morgan et al. | 430/350 |
| 3,570,383 | 3/1971 | Berg | 354/300 |
| 3,679,369 | 7/1972 | Hashimoto et al. | 354/300 |
| 4,059,409 | 11/1977 | Barto et al. | 354/300 X |
| 4,166,728 | 9/1979 | Degenhardt et al. | 354/300 |
| 4,473,282 | 9/1984 | Michlin | 354/300 |
| 4,518,843 | 5/1985 | Antol et al. | 219/121 LC |
| 5,023,654 | 6/1991 | Matsumoto et al. | 355/27 |
| 5,033,465 | 7/1991 | Braun et al. | 128/205.27 |
| 5,078,132 | 1/1992 | Braun et al. | 128/206.12 |

OTHER PUBLICATIONS

"Model 258B Continuous Thermal Processor" 3M Brand, Illustrated Parts Manual, Microfilm Systems, 3M Company, May 1975, 78-6969-1537-6.

*Primary Examiner*—D. Rutledge

*Attorney, Agent, or Firm*—Gary L. Griswold; Walter N. Kirn; Susan Moeller Zerull

[57] ABSTRACT

The present invention provides an alternative filtering system for use with a photothermographic developing apparatus. The inventive filtering system is a three stage system which provides for condensation of fatty acids and removal of particulates prior to absorbing odor causing by-products of photothermographic development.

12 Claims, 1 Drawing Sheet

FILTER FOR A PHOTOTHERMOGRAPHIC DEVELOPER

BACKGROUND OF THE ART

1. Field of the Invention

The present invention relates to apparatus used for the thermal development of photothermographic media. In particular, the present invention relates to a filter for use in such thermal development apparatus.

2. Background of the Invention

Thermographic and photothermographic imaging systems based on the generation of silver images by the thermally induced reduction of silver salts are well known in the art. A silver image is generated by the localized (imagewise) reduction of a silver salt, typically an organic silver salt with little or no light sensitivity (referred to as a light insensitive silver salt), by a reducing agent for silver ion. In a thermographic system, the differentiation between the image and the background is controlled by imagewise distribution of heat, with the silver image being formed where heat is applied. In a photothermographic system, a light sensitive silver salt (i.e., silver halide) is placed in catalytic proximity to the light insensitive silver salt. When actinic radiation strike the silver halide, which is sensitive or has been spectrally sensitized to radiation of that wavelength, metallic silver (unoxidized silver, Ag°) is photolytically formed. The photolytically formed silver acts as a catalyst for the further reduction of silver salt, including the light insensitive silver salt in catalytic proximity to the silver halide. Upon heating of the radiation-exposed photothermographic element, the light insensitive silver salts, which are in catalytic proximity to exposed silver halide having photolytically formed silver specks, are more rapidly reduced by reducing agent than are the light insensitive silver salts further from the exposed silver halide. This causes the silver image to be primarily formed where the photothermographic element was irradiated.

The most common type of photothermographic element which is commercially available comprises a silver halide as the light sensitive silver salt (either as in situ formed silver halide or preformed silver halide), a silver salt of an organic acid (usually a salt of a long chain fatty acid (e.g., having carbon lengths of 14 to 30 carbon atoms, such as behenic acid) as the light insensitive silver salt, a photographic silver halide developer or other weak reducing agent as the reducing agent for silver ion, and a binder to hold the active ingredients together in one or two layers (e.g., U.S. Pat. No. 3,457,075).

Development usually occurs by placing the exposed photothermographic element in contact with a heated surface (e.g., a heated roller or platen) or in an inert heated fluid bath. The heated rollers used in the past have generally been fairly open to the environment which has enabled any innocuous materials generated or evaporated by the heating step to escape to the atmosphere. Newer types of imaging systems sometimes are often used in closed work areas or are completely closed systems which do not have ready venting to the atmosphere. Requiring a dedicated venting or exhausting system for these thermal developing units would be burdensome on the users.

Commercial models of thermal processors for photothermographic elements, such as the 3M Model 259B Continuous Thermal Processor, have contained some filtering means on the equipment. In that processor, the filtering means is separated from the actual thermal development area of the processor as shown in the Illustrated Parts Manual for that processor. This filter acts to capture airborne condensate formed from material evaporated from the thermally developed media.

The inventors have found that during thermal development of photothermographic elements in a closed imaging unit certain harmless materials that evaporate during the thermal development step form deposit on the interior of the unit. This condensation of materials (such as the free fatty acid generated upon reduction of the silver salt and then evaporated during development) can adversely affect many aspects of the imaging process. The condensation may clog vents and cause the developer unit to overheat. The condensate may deposit on the heating element and cause localized insulation of the heated surface in a random fashion, producing image variations across the imaged element. Deposits on the pressure rollers can also lend to image variation from differential heating or can cause marking (pressure marking or transfer deposition) on the film. Electronic components can fail due to corrosion when exposed to released vapors. The condensate may deposit on or be transferred to imaging media or seams of the unit. The deposits cause an unsightly appearance and may leave greasy materials on the hands of anyone using the unit. These problems made finding a means of removing the evaporated materials from the vent stream without the need of a dedicated vent (e.g., a vent that accesses the exterior of a room or building or a special ducted vent stream within a building) a necessity.

Copending application Ser. No. 08/239,888 discloses a filter system for use with a photothermographic developing apparatus. Due to damage of filter materials by the relatively high temperatures of the exhaust materials, irregular rates of deposition of condensate in the filter causing channelling, heating of the filter material which prevented continuous deposition of the evaporate, and desirability of moldability, only bonded absorbent particulate filter media, particularly bonded carbon was deemed acceptable. The absorbent particulate filter media serves as the substrate for condensation as well as the absorbing substrate for odor causing by-products. The photothermographic imaging/developing apparatus preferably vents from at least two locations in the imager/developer. The application indicates a preference for locating the filter system within the housing of the developing apparatus and shows a filter system located above the heating element of the developing unit.

SUMMARY OF THE INVENTION

The present invention provides an alternative filtering system for use with a photothermographic developing apparatus. The inventive filtering system is a three stage system which provides for condensation of fatty acids and removal of particulates prior to absorbing odor causing by-products of photothermographic development.

The filtering system comprises:

a) an inlet through which hot processing gases are directed to b) a heat conducting, condensate accumulator, c) a particulate filter located at the exit of the heat conducting, condensate accumulator and upstream from, d) an absorbent block, and e) an exit through which the filtered air leaves the filtering system.

DETAILED DESCRIPTION OF THE INVENTION

Figure 1:
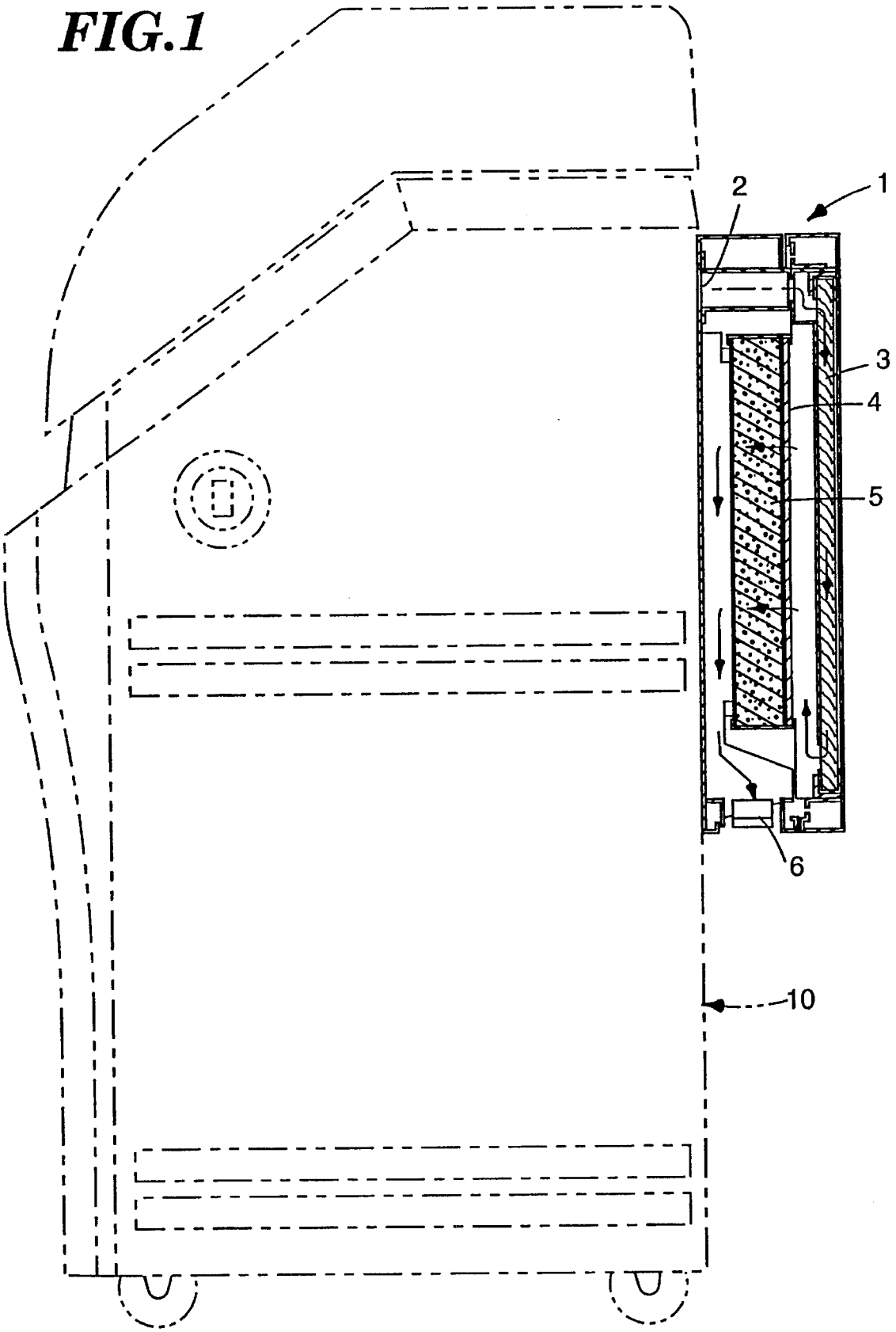
FIG. 1 shows an illustration of a representative filtering system within the scope of this invention.

Photothermographic imaging media are first exposed to radiation to create a latent image and then the media are thermally developed to convert the latent image to a visible image. Amongst the thermal developing systems employed for photothermography have been platens (flat or curved), inert fluid baths (e.g., oil baths), and rotating heated drums. A cylindrical heating element (either a rounded platen or circular drum) offers the best performance and compactness in a developer unit. Such cylindrical developing units are shown for example in U.S. Pat. No. 4,518,843 and U.S. patent application Ser. Nos. 07/862,850 and 07/942,633. Attempts to merely place these commercial thermal developing units into an enclosed imaging/developing system encountered immediate problems with deposition of materials evaporated from the thermally developed media. The material deposits occurred both inside and outside of the enclosed apparatus. Moreover, with certain photothermographic media, trace solvents evaporated which, within the confined space of the apparatus or a small room, could cause a significant odor. The primary source of the odor appeared to be aldehydes, and particularly butyraldehyde from within the photothermographic media. Other solvents such as toluene, acetic acid, methyl ethyl ketone, and butyric acid can also contribute to odor problems.

Initial efforts to remove the effluents that were depositing within the housing revealed that the number and location of vents streams within the processor were important. In particular, the inventors found that merely placing one or more vents within the segment of the processor where the thermal development drum or platen was located would not remove sufficient amounts of the effluent to provide long term protection of the apparatus. In addition to materials being vaporized on the thermal drum or platen itself, the inventors determined the photothermographic element was still sufficiently hot after removal from the drum and during transportation of the developed media to an external port for delivery to the user that significant amounts of effluent were still coming off the media.

To assure that the internal areas of the processor are protected from all sources of volatiles that could redeposit within the processor, at least two separate venting areas are necessary within the processor. One vent can be located above the thermal drum or platen. As heat rises, it is easier to provide the vent at a location to where the heated gases rise. The vent intended to collect the vapors from the heating drum does not have to be located directly above the drum, particularly when it is assisted by reduced pressure to enhance the flow of gases into the vent stream. However, having the vent above the center of mass of the drum may be convenient.

The second vent may also be located within the portion of the processor housing the heating roller or drum, but should be located closer to the stripping point of the media and the drum (the point at which the media and the drum separate from each other) so that there is no longer any thermal conduction between the drum and the media. The vent associated with the splitting or separation point on the drum may be located above or to the side or just below that point on the exterior direction within the housing. The use of reduced pressure (e.g., exhaust fan or pump) will facilitate removal of the vapors here, just as it does with the vent 'above' the heating drum.

Referring to FIG. 1, the filter unit 1 is preferably attached to the outside of the housing 10 for the processor unit, for compactness and aesthetics. Locating the filter system outside the housing 10 eliminates or reduces problems caused by the heat within the processor unit. For example, the carbon media has been found to have improved capacity at the lower temperatures found outside the processing unit. The cooler temperatures also allow the fatty acids to condense onto surfaces prior to entering the absorbent media. Having the filtering system located outside of the processor housing 10 also allows for ease in maintenance. Finally, the external location enables easy removal of the filter system and replacement with an adaptor which provides a means for attaching the machine to external building vents or ducts.

The vents from the developing units carry heated air and by-product gases to the inlet 2 of the filtering system. The heated air and by-product gases then enter the first stage of the filtering system, the heat conducting, condensate accumulator 3. At this stage of the filtering system the warm air stream coming out of the processing chamber is cooled and the higher molecular weight materials, such as fatty acids, condense or precipitate out of the air stream. The inventors have found that in addition to condensing on the surface of the heat conducting, condensate accumulator 3, some fatty acids form solid particles which are carried along in the air stream.

This heat conducting, condensate accumulator 3 may take a variety of different forms such as a long or circuitous path through a high heat conducting material such as a metal, a thermoelectric cooling system (Peltier cell), or a heat exchanger having a cooling fluid, such as cooling water. A complex heat exchanger is not required, however. A suitable, yet simple, system which may be used is passing the heated air down the length of a metal matrix. An aluminum mesh has been found to work well as it provides a large amount of cooling surface over which the heated air can pass and on which the condensates may accumulate. The length and thickness or number of layers of the mesh may be varied as necessary to provide sufficient cooling and condensation surfaces.

Although a variety of materials may precipitate from the hot air stream when passing through the heat conducting condensate accumulator, fatty acids are the predominant material accumulated. Applicants have found that the fatty acids not only condense but also solidify when passing through the heat conducting, condensate accumulator. While most of the solids stick to the metal matrix some solid particulates are carried along in the exhaust air stream.

After being cooled in the first stage of the filter system the process air passes through a particulate filter 4. The need for the particulate filter 4 was determined when the inventors noted that some fatty acids formed solid particulates upon cooling which were carried along by the air stream. In addition to removing the particles of fatty acid, the particulate filter 4 removes other airborne debris which may be generated in the processor. The particulate filter 4 removes these airborne particulates which might other wise contaminate or cause blockages in the absorbent block 5. The particulate filter 4 also reduces the likelihood of particulates being exhausted into the user's environment. Any particulate air filter may be used. The choice of the particulate filter may be in part a balance of low pressure drop and high removal efficiency. Moreover, a bulky particulate filter is less desirable since the entire filter system is preferably mounted on the outside of the processor housing. Filtrete™ filters work well since they have high efficiency, cause relatively low pressure drops, and are not unreasonably bulky.

After passing through the first two stages of the filtering system the air stream passes through the absorbent block 5. The absorbent block 5 removes odorous materials, such as aldehydes, from the air stream. The absorbent materials used in this third stage should be selected so that it effectively removes the odor causing vapors released during thermal processing of the photothermographic element. These vapors usually include one or all of the following: aldehydes, and particularly butyraldehyde, toluene, acetic acid, methyl ethyl ketone, and butyric acid.

The absorbent block 5 may be composed of a single odor absorbing material or may comprise two or more different types of odor absorbing material. The absorbent materials may be combined by either mixing the various filtering and reactive materials together into a well distributed mixture, forming a two or more layered filter element with the various filtering activities distributed in distinct layers, or by making two distinct filter materials which are placed next to each other within the filter cartridge. The absorbent material may be provided in various forms including a packed bed. However, bonded absorbent particulate filter media have certain advantages, including a generally lower pressure drop.

Bonded absorbent particulate filter media are described for example in U.S. Pat. Nos. 5,033,465 and 5,078,132. The bonded filter media may be described as spaced absorbent granules or particles which are bonded to one another by adherent binder particles distributed between the absorbent granules. The binder particles do not form a continuous phase surrounding the absorbent particles, but allow for gases to move throughout the bonded structure. The binder particles are preferably very evenly distributed throughout the bonded structure and around the absorbent granules to provide uniformity to the flow characteristics of the bonded filter medium. Where particular absorption characteristics are desired in the bonded filter medium, the binder particles may be comprised of a polymer which has particularly desired chemically reactive or chelating sites in or pendant from the polymer chain.

Any thermally softenable particulate binder can be used as the binder particle, but polyolefins, nylons, and polyurethanes are preferred. Mixtures of polymeric binder particles may also be used to tailor the structural and absorbance characteristics of the filter media. The bonded carbon also maintains its shape well, which helps to eliminate the formation of channels through the filter.

The preferred absorbent material is carbon, and particularly activated carbon granules. A block having two different carbons, one which absorbs aldehydes and one which absorbs organic vapors and acid gases, is most preferred. The two different carbons may be mixed or may form two different sections of the block in series. Activated carbon particles are commercially available and are generally designated in the art by their absorptive characteristics with respect to specific types of materials. For example, activated charcoal is commercially available from suppliers under designations such as "Formaldehyde Sorbent," "Organic Vapor Sorbent," Acid Gas Sorbent," and "Organic Vapor/Acid Gas Sorbent." In general, any carbon filter material may be used in the practice of the present invention, with various levels of benefits over many other commercially available filter materials. However, the activated carbon particles, and most especially the Organic Vapor/Acid Gas Sorbent and formaldehyde sorbent types of activated carbon particles are preferred. Filters made from bonded absorbent particles, and particularly bonded carbon, were found to be better filter materials for vent streams from photothermographic developing units as compared to zeolites, impregnated foams, or coated fibers. The bonded absorbent particulate fibers used in the practice of the present invention showed more uniform absorption of material throughout the body of the filter (reducing channelling and clogging of the filter cartridge), greater absorption capacity, and the ability to absorb a more diverse range of materials exiting the thermal developer unit.

Preferably, the outlet of the filter system is equipped with a fan 6 that pulls the air from the processor through the filter. Locating the fan 6 at the exit of the filtering system, rather than at the inlet, is advantageous in that the fan 6 is protected from fatty acid deposits and other materials which may damage the fan 6.

The materials selected for the construction of the frame, cartridge, etc are not critical. Any material which can be formed into the appropriate shape with meaningful structural properties can be used. It is preferred to use metals, polymeric materials, composites or the like for the construction of these parts of the equipment.

What is claimed:

1. A filter system for use with a photothermographic thermal developing apparatus comprising a) an inlet through which hot processing gases are directed to b) a heat conducting, condensate accumulator, c) a particulate filter located at or after the exit of the heat conducting, condensate accumulator and upstream from, d) an absorbent block, and e) an outlet through which the filtered air leaves the filtering system.

2. The filter system of claim 1 wherein the heat conducting, condensate accumulator comprises a metal matrix.

3. The filter system of claim 2 wherein the heat conducting, condensate accumulator comprises aluminum mesh.

4. The filter system of claim 1 in which the absorbent block comprises activated carbon.

5. The filter system of claim 4 in which the absorbent block comprises two types of activated carbon.

6. The filter system of claim 5 in which the two different activated carbons are mixed together.

7. The filter system of claim 5 in which the two different activated carbons are found in separate sections of the absorbent block.

8. The filter system of claim 5 in which one of the activated carbons absorbs aldehydes while the other type absorbs organic vapors and acid gases.

9. The filter system of claim 1 in which the outlet comprises a fan to pull air from the developing apparatus through the filter.

10. A thermal developing unit for the thermal development of photothermographic media which comprises, in a housing, a means for thermally developing photothermographic media by placing said media in contact with a heated element within a case, and, attached to the outside of the housing, a filter system comprising a) an inlet through which hot processing gases are directed to b) a heat conducting, condensate accumulator, c) a particulate filter located at or after the exit of the heat conducting, condensate accumulator and upstream from, d) an absorbent block, and e) an exit through which the filtered air leaves the filtering system.

11. The thermal developing unit of claim 10 wherein the heat conducting, condensate accumulator comprises aluminum mesh.

12. The filter system of claim 10 in which the absorbent block comprises activated carbon.

* * * * *